US006199271B1

(12) United States Patent
Hahn et al.

(10) Patent No.: US 6,199,271 B1
(45) Date of Patent: Mar. 13, 2001

(54) METHOD AND APPARATUS FOR JOINING METAL SHEETS AND THE LIKE

(75) Inventors: Ortwin Hahn, Paderborn; Volker Schulte, Eichenweg 22, 59939 Olsberg, both of (DE)

(73) Assignee: Volker Schulte, Olsberg (DE)

( * ) Notice: Subject to any disclaimer, the term of this patent is extended or adjusted under 35 U.S.C. 154(b) by 0 days.

(21) Appl. No.: 09/229,731

(22) Filed: Jan. 13, 1999

(51) Int. Cl.[7] ..... B23Q 17/00; B23Q 1/00; B23P 21/00; B23P 19/04; B25B 27/14

(52) U.S. Cl. ..... 29/715; 29/407.01; 29/283.5; 29/254; 29/275; 29/276; 29/521

(58) Field of Search ..... 29/407.01, 715, 29/283.5, 254, 275, 276, 521

(56) References Cited

U.S. PATENT DOCUMENTS

| | | | | |
|---|---|---|---|---|
| 3,146,524 | * | 9/1964 | Tetzloff | 29/407.01 |
| 3,883,938 | * | 5/1975 | Schmidt et al. | 29/715 X |
| 4,607,418 | * | 8/1986 | Hafner | 29/715 |
| 4,864,713 | * | 9/1989 | Roberts et al. | 29/715 |
| 5,315,743 | * | 5/1994 | Schleicher | 29/283.5 |
| 5,357,668 | * | 10/1994 | Roberts | 29/407.01 |
| 5,887,339 | * | 3/1999 | Schmidt | 29/715 |
| 6,012,215 | * | 1/2000 | DeMoura | 29/283.5 |
| 6,014,802 | * | 1/2000 | Guerin | 29/407.01 |

FOREIGN PATENT DOCUMENTS

| | | | |
|---|---|---|---|
| 197 01 252 | 7/1998 | (DE) . | |
| 197 18 576 | 11/1998 | (DE) | B21D/39/03 |

* cited by examiner

*Primary Examiner*—S. Thomas Hughes
*Assistant Examiner*—Marc Jimenez
(74) *Attorney, Agent, or Firm*—Husch & Eppenberger, LLC; Robert E. Muir; Kevin M. Kercher

(57) ABSTRACT

The invention concerns an apparatus and a method for mechanically joining metal sheets, profiles and/or multi-sheet joints lying on top of each other, wherein joining tools are moved by power means towards the parts to be joined and a joint is made between the parts to be joined by the force effect of the joining tools. To make the joining tools easier to handle and widen the range of application for joints, it is proposed to reduce the reaction forces of the joining process by the fact that one joining tool applies the joining force to the joint at an exciting frequency which is above the characteristic frequency of the opposite joining tool, and the mounting of at least one joining tool is isolated from vibrations. The vibration isolation can also be arranged exclusively or in addition in the excited joining tool or the parts to be joined.

16 Claims, 5 Drawing Sheets

METHOD AND APPARATUS FOR JOINING METAL SHEETS AND THE LIKE

BACKGROUND OF THE INVENTION

The present invention concerns an apparatus and a method for mechanically joining metal sheets, profiles and/or multi-sheet joints lying on top of each other, wherein joining tools are moved by power means toward the parts to be joined and a joint is made between the parts to be joined by the force effect of the joining tools.

Mechanical joining techniques for connecting parts to be joined such as for example metal sheets are increasingly gaining in importance, as they have some advantages specific to the method. Patent DE 197 01 252.3 describes a method as well as connecting means for joining metal sheets by punch riveting. For this it is explained inter alia that punch riveting of 1 mm. sheets of ZSTE 420 material requires forces of 74 kN which are not attainable with ordinary riveting machines. The solution proposed there, of providing the rivet with a blunt circular or annular front surface with which the metal sheets are pierced, allows a reduction of the necessary work forces compared with the state of the art known at the time. Also the lateral or angular offset of the tools or tool portions, which would reduce the joint quality or make a connection completely impossible, is reduced by the shot-like operation. Whereas this process perfectly reduces the lateral or angular offset, the drawback of the shot-like operation lies in that considerable measures must be taken to make it safe to use. The propellant charges which are used for the shot-like operation are potentially, in case of improper handling, not completely risk-free.

In patent DE 197 18 576 are described an apparatus and a method for mechanical joining techniques. In particular in FIGS. 4 and 5 is shown a typical force/displacement graph for the working movement of the stamp. Patent DE 197 18 576 however instructs only that individual or several working members for making a mechanical joint can be controlled or regulated in their movement and/or force, but without going into the basic problem of reducing the high forces for making a mechanical joint. According to the state of the art described there, the transforming energy required is applied by hydraulic cylinders which make the respective joint in a single quasi-continuous stroke movement. This publication contains no indication as to how the method and the apparatus for making joints can be improved by weaker joining forces.

Accordingly it is an object of the present invention to provide an apparatus and a method for mechanical joining which allow weaker reaction forces in the making of the mechanical joint.

It is a further object to provide an apparatus and a method for mechanical joining which allow a correspondingly lighter design and easier handling of the joining tools.

SUMMARY OF THE INVENTION

The objects are achieved, according to the method of the invention, by the transforming energy or joining force required being applied to the joint to be made by several impacts in rapid succession of a joining tool or in pulsed fashion at an exciting frequency, wherein the opposite joining tool, the excited joining tool and/or the parts to be joined are resiliently mounted and the characteristic frequency of the opposite joining tool, the excited joining tool and/or the parts to be joined is lower than the exciting frequency.

The apparatus according to the invention comprises at least one percussion mechanism which, to make a mechanical joint, within a short time applies several successive impacts or a pulsating force to one of the joining tools, wherein the opposite joining tool, the excited joining tool and/or the parts to be joined are resiliently mounted and the exciting frequency at which the joining tool can be excited is higher than the characteristic frequency of the opposite joining tool, the excited joining tool and/or the parts to be joined. Primarily single-part or multi-part stamps and dies are considered as the joining tools, and secondarily also strippers and hold-down devices.

The hold-down forces act statically on the parts to be joined. This static load remains unchanged even if the joining tools do not exert a working stroke, but several successive impacts, and this static load must be taken up by the frame and the one opposite the hold-down device. If an opposite joining tool is mounted flexibly in order to be isolated from vibrations, the static load of the hold-down device can cause a major deflection of the vibration-isolated opposite joining tool. In order to at least reduce this deflection and loading of the frame caused by the static load, it is proposed to synchronize the movement of the hold-down device by coupling means such as for example a mechanical drive link via a driver link plate or a hydraulic valve-controlled tracking control means with the movement of the joining tool. The same applies to strippers. If the hold-down force is applied non-dynamically as described above or controlled by magnets, the deflection caused by the static forces can be at least partially compensated by active position control at one or both joining tools, by the fact that the latter are movable by control means in a direction opposite the static deflection.

The several successive impacts of the percussion mechanism make it possible to work with smaller force peaks in the substructure in case of resilient mounting of the opposite joining tool and a large mass and/or weak springs of the opposite joining tool, as the joining force needed to make the mechanical joint is now no longer applied in a single stroke, but the exciting frequency of one joining tool which exceeds the characteristic frequency of the opposite joining tool allows vibration isolation of the resiliently mounted opposite joining tool. In this case it is important to form a vibrating system which is optimally matched to the joint to be made. Thus it is advantageous, with as large a mass as possible of the opposite joining tool and as weak as possible springing, to ensure that this unit exhibits as low as possible a characteristic frequency, because then at a frequency which is by contrast as high as possible, at which the other joining tool is excited, the reaction forces are reduced to a minimum. The substructure is therefore vibrationally uncoupled from the applied joining force, and only fractions of the applied joining force act on the substructure. High-frequency impacts in rapid succession allow most of the joining force to be used for plastic deformation of the sections of the parts to be joined which are involved in the joint as well as of any auxiliary parts to be joined such as rivets.

Here the rule that as the degree of isolation increases, the higher the exciting frequency in relationship to the characteristic frequency of the parts to be joined and of the opposite joining tool, holds good. For the present invention can be used not only when at least two joining tools are involved in making the joint, but also when the parts to be joined have sufficient inherent stability to remain in a still acceptable form when only one joining tool excited at one frequency is used. To this extent the term "opposite joining tool" as used within the scope of the description and claims can be understood to include "component" if an actual "opposite joining tool" is lacking. In such cases it is sufficient, instead of the opposite joining tool, to mount the parts to be joined in such a way that their characteristic frequency is as low as possible. An additional reduction of reaction forces results if not only the opposite joining tool but also the excited joining tool are vibration-isolated relative to the substructure. Such vibration isolation can be caused for example via the pressure medium of the delivery unit. Thus with a pneumatic mechanism the gas acts like a spring which causes vibration isolation. Naturally the vibration isolation can also take place via components with a preferably larger mass such as for example carrier plates and with a resilient mounting, which then for example isolate the percussion unit and/or the delivery unit from vibrations.

Naturally the effects of the invention can also be achieved if only the excited joining tool or the delivery unit and/or the percussion mechanism is isolated from vibrations.

In a preferred embodiment, not only is operation carried out with simply successive impacts, but the joining force is applied in pulsed fashion. By "pulsed" is herein meant that over a time interval the force is applied to the joint rising and falling in waves. A static basic load is therefore then maintained. In the process the frequency or amplitude of the force wave can be modulated.

Also the C-frame of the apparatus in spite of vibration isolation of the joining tools is set in vibration to an extent dependent on the respective individual case. It thus forms together with the vibrating tools or components a coupled vibrating system. The frame must be regarded as a continuum with respect to vibrations and therefore theoretically has an infinite number of characteristic frequencies. In order to use this potential advantageously, according to an embodiment of the invention the frame of the apparatus can be influenced in its vibrating behavior. This can be achieved for example by means of displaceable additional masses or variably insertable and/or adaptable reinforcements.

At a high exciting frequency of impacts of the joining tool, high peak forces arise due to the short time of action. Accordingly the contact pressure of the joining tool vibrating at the exciting frequency can be reduced, and in comparison with the prior-art apparatuses and methods for making a mechanical joint only a relatively small application of primary forces is required. Depending on the boundary conditions of the joining process it is conceivable that the excited joining tool no longer needs to be pressed on, but even just guided. Also the reaction forces which arise during the process of mechanical joining are correspondingly weaker, which in turn allows apparatuses and tools which are easier to handle and which greatly expand the range of application of sheet metal joining by transforming techniques or open up new applications for mechanical joints.

In particular, with longer-range C-frame grippers, connecting points which are no longer located only in the immediate boundary vicinity of the components can be reached. The C-frame structures become lighter and the methods of joining by transforming techniques become more flexible due to the procedure according to the invention. It is even possible to integrate the apparatus according to the invention or the method in hand tools which, with correspondingly low investment costs, allow much wider application possibilities for mechanical joining even in the workshop and do-it-yourself spheres. The apparatus and method according to the invention seem to be applicable to nearly all spot-type methods of joining by transforming techniques.

The invention can also be realized correspondingly in an apparatus which comprises no common frame and in which the ram and the die are each guided in a separate support.

The solution according to the invention also is suitable for use in blind riveting technology, for example even for the method described in DE 197 01 252.3, or in bilateral connection with function carriers with or without prepunching of the location of the joint. Punch nuts and bolts as self-punching functional components need no prepunching of the joint location and so save a manufacturing step. In the single-stage method with punch nut, the shaped part to be joined is positioned simultaneously with the punch nut in the tool. The connecting element punches through the shaped metal sheet and, in cooperation with the die, produces a form-locking joint with the material of the shaped metal sheet. In this case material flows into an annular groove. A punch bolt is assembled in a similar single-stage method. The two-stage assembly process requires transformation of the connecting element and of the shaped metal sheet.

For this purpose the shaped metal sheet is positioned over a die and preshaped, trimmed and cut through by the punching and riveting section of the connecting element. The punching and riveting section presses against a cutting and beading stamp of the die and, widening in the process, is beaded on. In continuation of the assembly process, the beaded-on end of the punching and riveting section encompasses the perforated edge of the shaped metal sheet completely and produces a closed peripheral U-shaped region of interlocking with the latter. Then the rivet head is leveled.

Also an apparatus according to the invention as well as a method can be used for automation. When using an electronic control and/or regulating device with associated sensor mechanism or actuator, for example the characteristic frequency of the opposite joining tool and/or of the parts to be joined can be determined during the joining process by modulation of the exciting frequency or by a test pulse which precedes the actual joining process. The frequency scan can take place for each individual joining process, but also by random sampling. The frequency scan can be used for quality testing of the parts to be joined, as frequency deviations indicate faults in the parts to be joined. Also the electronic control and/or regulating device can monitor the respective joining process with an integrated test program, evaluate and/or store the parameters and so be an element of a quality testing system of manufacture which is integrated in production. When the electronic control and/or regulating device detects the characteristic frequency, it can access stored parameters which allow the joining process to be influenced positively in the desired manner by varying the exciting frequency and/or other parameters relevant to the joining process. Also it is conceivable to let a robot, which is intended to fix parts to be joined to each other with several mechanical joining points, run a program, different parameters of the individual joining points being stored and automatically converted in the program. Thus for example different sheet metal thicknesses, frequencies, impact distances, impact speeds, impact strength and number of impacts and elasticity values of the bearings can be individually controlled and/or regulated for each individual joining point. For ordinary control/regulation, just the impact and/or delivery parameters can be evaluated. Also it is conceivable for example to increase the joining force towards the end of the joining process to a pulse-like impact, in order for example to smooth an applied rivet or the joining surface in planar fashion. For the forces occurring with a pulse-like impact, the tools such as for example C-frame grippers do not need to be designed for static loading, because the force peaks can be cushioned. In this way the tools can remain light. Also the proposed apparatus as well as the method allow high flexibility of manufacture, because with electronic control completely different parts to be joined can be fixed together successively if the work program is simply loaded in the command memory of the electronic control and/or regulating device.

In a further embodiment of the invention at least one of the joining tools and/or a hold-down device is constructed as an electromagnet. Alternatively one of the joining tools or a hold-down device can be made of a material with ferromagnetic properties, in which case an electromagnet arranged in the region of the apparatus acts on the latter. By applying the magnetic forces and a rational combination of them and distribution to joining tools, parts to be joined and hold-down device, not only is it possible to use them on joints in ferromagnetic parts to be joined, but also components made of non-magnetic materials can be held down, as the magnetic field lines penetrate the material and so for example hold-down device and die can attract each other. The non-magnetic parts to be joined located between them are in this way pressed against each other. If the hold-down device is constructed as a magnet, when connecting or punching parts to be joined of which at least the lowermost one has ferromagnetic properties, the companion tool can also be eliminated with thin and unstable components.

Further objects, advantages, and/or embodiments of the invention may be perceived from the following detailed description and the claims.

BRIEF DESCRIPTION OF THE DRAWINGS

The invention is described in more detail with the aid of practical examples shown in the drawings, wherein.

DETAILED DESCRIPTION

Figure 1:
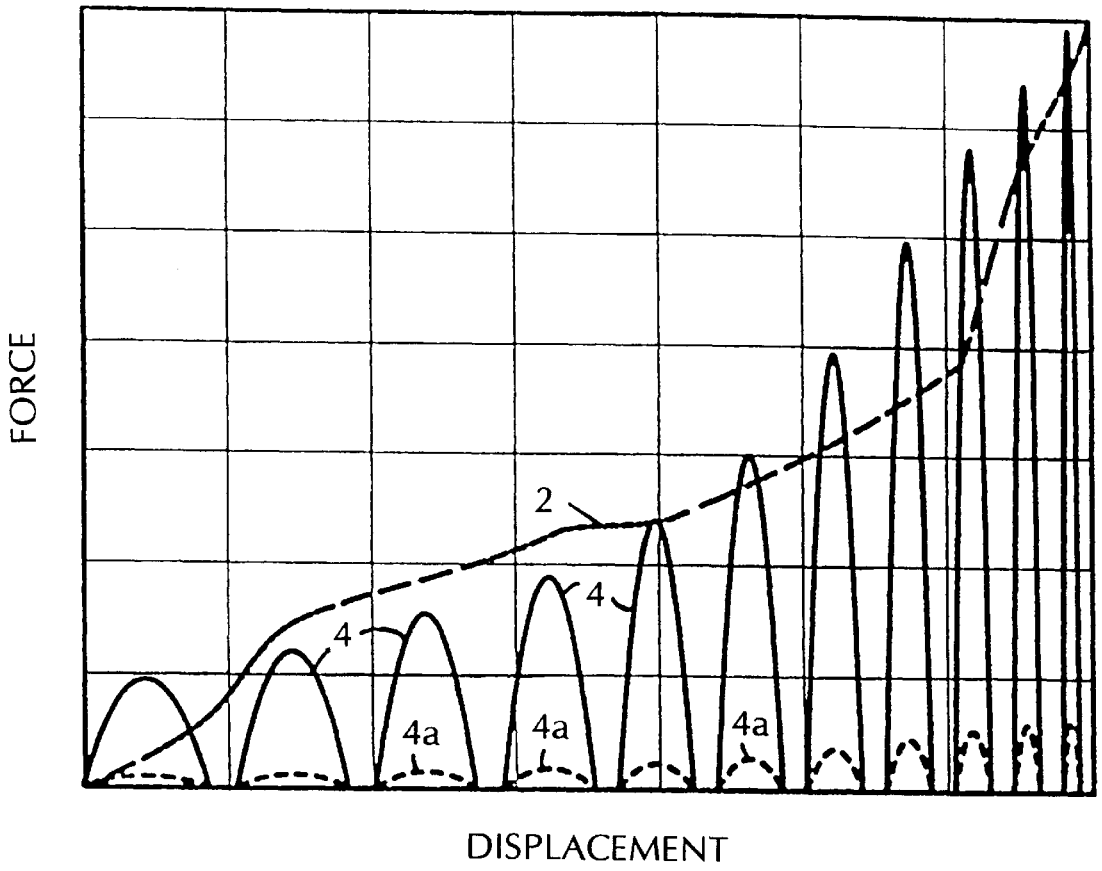
FIG. 1 is a graph which shows the curve of the joining force over the joining displacement firstly according to the known state of the art; and secondly as an example of an embodiment according to the present invention, wherein on the one hand the force at the joining point and on the other hand the force in the substructure are shown.

FIG. 1 is a force/displacement graph with a line with long dashes 2 and curves of a joining force over the joining displacement. In the curve of a joining stroke of the joining tool, the power consumption rises particularly towards the end of the joining stroke. The reaction forces must here be taken up statically in the substructure. The curve of joining force 2 shown corresponds to the known state of the art. By contrast the curve of joining force over the joining displacement with successive, preferably high-frequency impacts is completely different. According to the preferred method of the present invention the curve of applied impact energy, which is measurable at the joining point, shows itself in a plurality of individual force peaks which are shown as an example in unbroken lines 4 in FIG. 1 and whose number over a given distance depends on the selected frequency. Naturally the frequency, the impact strength, the impact speed and/or the duration of impacts within an individual joining process or several joining processes independent of each other can be varied. Depending on the exciting and characteristic frequencies of the joining tools, but also of the parts to be joined and the damping characteristic of the resilient mounting of the opposite joining tool, a satisfactory design of the apparatus can be found in which the reaction forces owing to the short pulses are no longer produced to the earlier known extent in the substructure. The force measurable in the substructure with the impact energy measurable at the joining point is shown in broken lines 4*a*. It is clear that the forces which must be taken up in the substructure with vibration isolation of the tools are much weaker than the forces according to the known state of the art.

Figure 2:
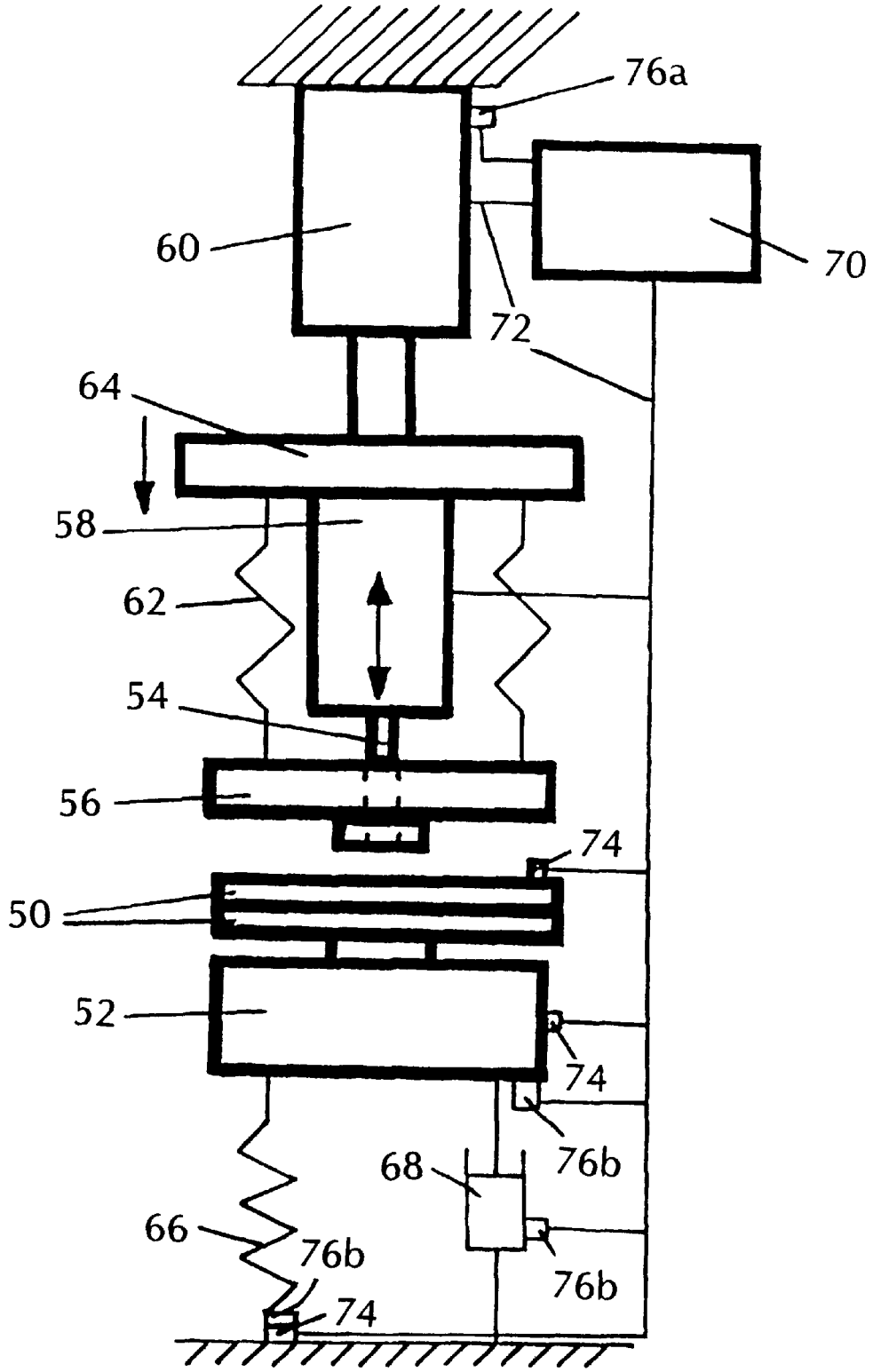
FIG. 2 is a diagrammatic illustration of an apparatus for industrial realization.

In FIG. 2 joining tools comprising die 52 and ram 54 act on the parts to be joined 50 to make a joint. The die 52 is movable and has a larger mass. The ram 54 works through a corresponding bore or opening in the hold-down device 56, the ram 54 according to the invention performing a kind of hammering movement. The hammering movement is produced by a percussion mechanism 58 in which the different drives can be accommodated. The percussion mechanism 58 moves the ram 54, which has a preferably smaller mass, at high impact frequency and with comparatively low impact energies. The percussion mechanism 58 can be driven pneumatically such as for example in a pneumatic chisel or a pneumatic hammer, electrically such as for example with a rotary crank drive or unbalance motors or electromagnetically, electro-pneumatically such as in a hammer drill or servo-hydraulically or in some other manner known in the art. The percussion mechanism 58 can be made very light in view of the low impact energies possible according to the invention and is guided during the joining process with only light contact pressure by the delivery unit or mechanism 60 which simultaneously also transmits via hold-down springs 62 the necessary hold-down force to the latter. The delivery unit 60 is in this case preferably, but not necessarily simultaneously also used for pressing the hold-down device. Between the delivery unit 60 and the percussion mechanism 58 in a further preferred embodiment can be arranged a moving base plate 64 of large mass with resilient mounting, which also serves for vibration isolation. Apart from the specific practical example, other structural embodiments of vibration isolation can be realized here too. The view of a resilient mounting also required for this is not shown in more detail in FIG. 2. Technically the delivery unit 60 can be realized with any of the above-mentioned or other known drive forms. The die 52 has a substantially larger mass than the ram 54 and is spring-mounted by means of the springs 66. This springing can be made separate or, using a C-frame, also achieved by a flexible design thereof. If occasion arises, damping 68 is to be provided. Also the springing can be achieved with a gas.

A variant of the apparatus or method could be realized with a synchronized manner of operation in opposite directions with the die 52 and ram 54 moving in synchronization for mass equalization. Also active adjustment to the maximum of the movements of the joining tools or parts to be joined would be technically conceivable. Also the required pressing forces of the percussion mechanism 58, which could be referred to as quasi-static forces, attain only low values. They are only insubstantially stronger than the forces required for the hold-down device 56.

Further, in FIG. 2 is shown an electronic control and/or regulating device 70 which is connected by electrical wires 72 to the actuators 76*a*, 76*b* or sensors 74. The actuators 76*a*, 76*b* and sensors 74 are shown only symbolically with their electronic interface. The electronic control and/or regulating device 70 is equipped with at least one microprocessor which controls the apparatus by suitable software. Thus the electronic control and/or regulating device 70 can for example by a sensor 74 determine the characteristic frequency of the parts to be joined 50, by triggering a test pulse via a control command to the delivery unit 60 and/or the percussion mechanism 58 as examples of actuators 76*a*, and measuring the characteristic frequency of the parts to be joined 50. Then, depending on the measured characteristic frequency of the parts to be joined 50, it can for example vary the spring hardness of the spring 66 by an actuator 76*b*, or control the active damping of the die 52 by countervibrations by an actuator 76*b*. The electronic control and/or regulating device 70 can have its own storage capacities in order to call up stored routines, performance characteristics or the like from there or to file data, or the electronic control and/or regulating device 70 exchanges data via a communications interface with other microprocessors.

With an ordinary experimental structure (comprising a drill stand, commercially available hammer drill with an impact energy of only 2.3 J, an impact number of 4200 l/min, die 52 and ram 54, but without a hold-down device 56) it could be demonstrated that a punch rivet which normally needs joining forces of 40,000 N can be joined by means of much lower pressing forces. The energy efficiency for the joining process should also be much better than with the previously common use of hydraulic cylinders. To reduce the erosion tendencies of the tools especially when joining aluminum, with rotationally symmetrical auxiliary joining elements or joining tools it is possible to superimpose a rotary movement on the impact movement of the ram 54. This combination of movements can easily be realized according to known principles of design.

In order also to eliminate the quasi-static forces of the hold-down device 56, as a variant when joining steel materials it is proposed to construct the die 52 as a strong electromagnet which is capable of pressing the metal sheets to be joined against the die without reaction forces.

Figure 3:
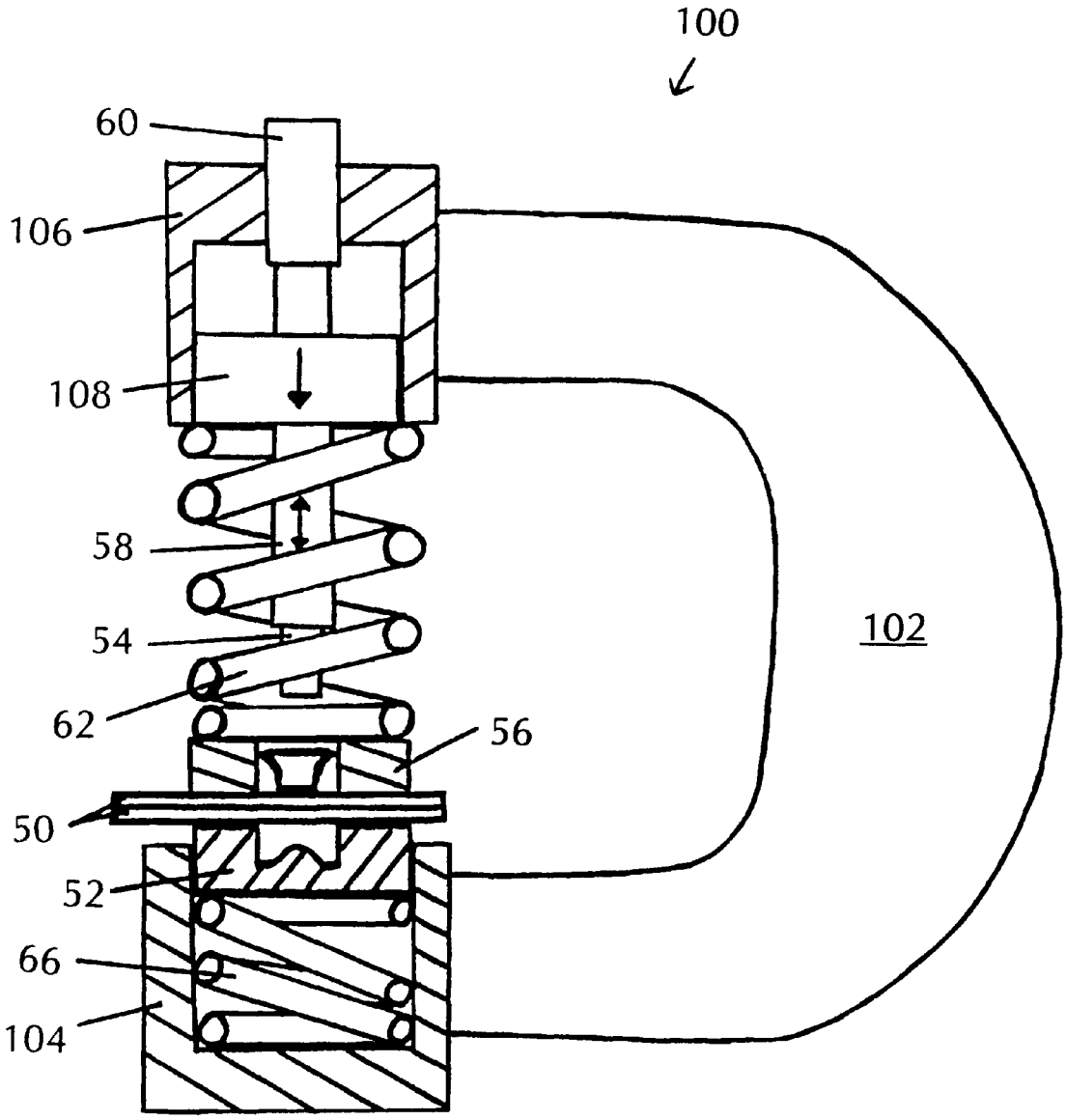
FIG. 3 is an illustration of the principle of construction of a C-frame gripper with percussion mechanism.

In FIG. 3 can be seen a C-frame gripper 100 whose C-frame 102 comprises at each end a bearing unit 104, 106. As used herein, the term "C-frame" should be interpreted to include any frame arrangement in which there are generally oppositely-facing bearing surfaces whose locations are generally fixed relative to each other. In the bearing unit 104 is mounted a delivery unit 60 which can be operated at low contact pressures. The delivery unit 60 moves a carrier plate 108 to which is attached a percussion mechanism 58, which drives a ram 54 with a small ram mass and a high impact frequency. Extending around the percussion mechanism 58 on the outside is the hold-down spring 62 which transmits the contact pressure of the delivery unit 60 to the hold-down device 56. In the bearing unit 106 is mounted the die 52 with a large mass on a supporting spring 66 which can also consist of an elastomeric material, a gas spring or some other spring damper system. The C-frame gripper 100 with the devices described can connect metal sheets 50 to each other permanently by mechanical joining. Owing to the now very low contact pressures it is possible to design the C-frame gripper as a hand tool or tool for high-speed robots, but also to make the upper and lower arms longer than shown in FIG. 3, without inadmissible bending moments and offset which can no longer be controlled, or can be controlled only at disproportionate cost, occurring as a result.

Figure 4:
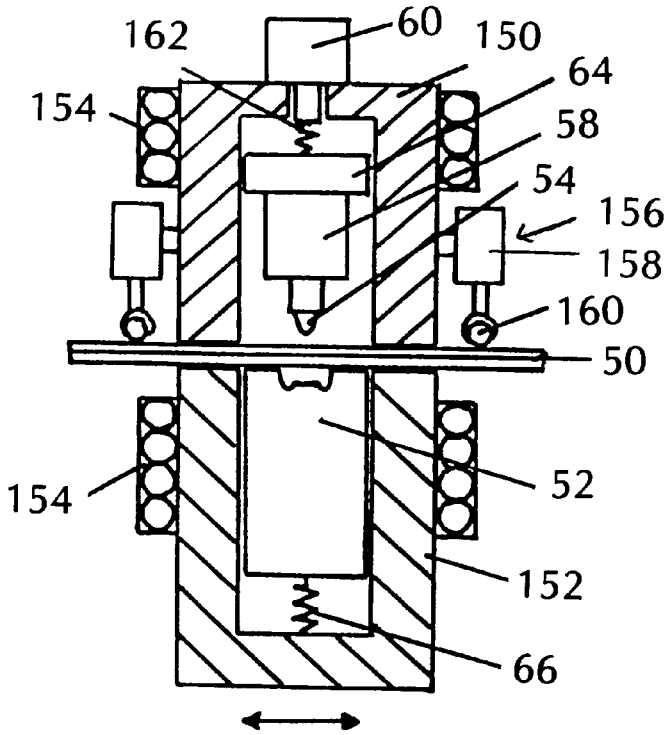
FIG. 4 is a schematic view of an apparatus which comprises no common frame and in which retaining forces are produced magnetically.
Figure 5:
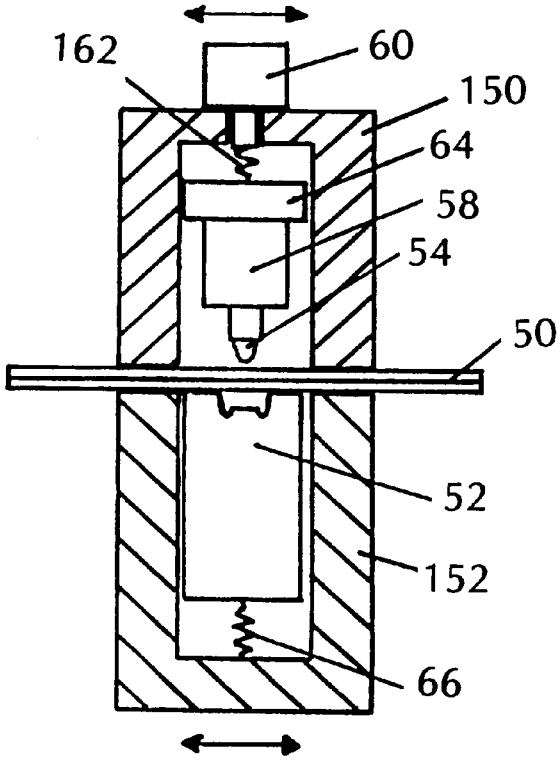
FIG. 5 is a schematic view similar to FIG. 4, but without magnets.
Figure 6:
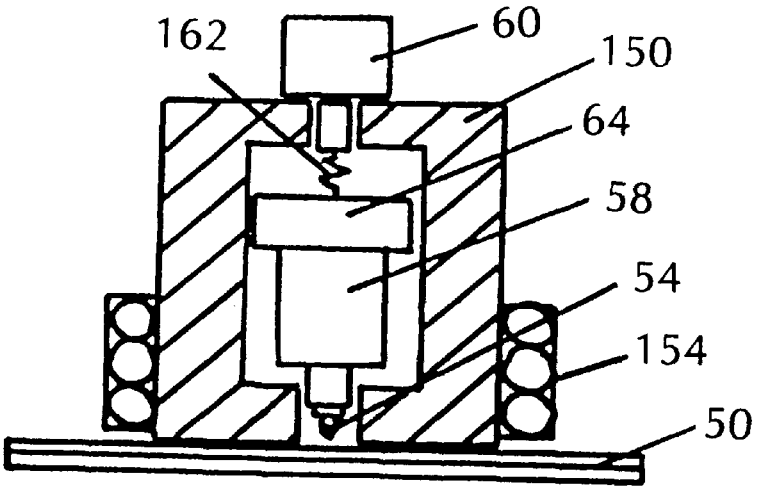
FIG. 6 is a schematic view of an apparatus without a die.

In each of FIGS. 4 and 5 is shown an apparatus in which the ram 54 and the die 52 are not held by a common frame 102. Also with the apparatus shown a joint can be made reliably. In a first guide housing 150 is guided the ram 54, and in a second guide housing 152 the die 52. In FIG. 4, magnet coils 154 for generating a magnetic field are mounted laterally on both guide housings 150, 152. Whereas the guide housing 150 is actively steered by a positioning unit into the position in which the ram 54 is to make a joint, the guide housing 152 is entrained by the connecting magnetic force. The positioning unit is shown in FIG. 4 by two laterally mounted traveling units 156 which comprise a lifting cylinder 158 for vertical guiding and a chassis 160 for the rolling movement of the guide housing 150. To move the guide housing 150, by deflection of the chassis 160 the guide housing 150 is lifted off the surface of the parts to be joined 50 and can move over the parts to be joined 50, guided by a control device not shown in more detail. When the new nominal position is reached, the chassis is pulled in, and the guide housing again sits tightly on the surface of the upper part to be joined 50. Due to the magnetic force operating through the parts to be joined 50 between the magnet coils 154, at the same time the guide housing 152 is pulled with it into the new position. In order not to let the frictional forces occurring between the surface of the lower part 50 and the contact surfaces of the guide housing 152 become too high, it is proposed to reduce the magnetic force between the magnet coils 154, in order then to increase it again for the next joining process. In this case the magnetic force during the joining process should be so high that it is sufficient to prevent a relative movement between the two guide housings 150, 152. Depending on which of the guide housings 150, 152 is on top, the top guide housing 150, 152 can also, instead of a chassis, be lifted and entrained by the magnetic field of the other guide housing, to avoid friction between the contact surfaces of the guide housing 150, 152 and the surface of the parts to be joined 50. At the joint the magnetic field can be switched from repel to attract. Alternatively guiding can take place by means of an air cushion combined with a magnetic field. In FIGS. 4, 5 and 6 the ram 54 is also mounted with vibration isolation by a spring 162.

FIG. 5 shows a simplified embodiment of the apparatus shown in FIG. 4. Instead of a positioning unit with lifting cylinders 158 and chassis 160, magnetic coils 154 or air cushions, here the joining tools 52, 54 are positioned by portal traveling units known in the art or industrial robots with a long range. However, higher expenditure must be applied here with respect to control of the portal traveling units or industrial robots, as the die 52 and the ram 54 are positioned one above the other, fitting as exactly as possible for an optimum joint. Laser measuring methods, ultrasound or the use of magnets in combination with inductive pickups can be used as an alignment aid in such a case.

FIG. 6 shows an apparatus in which on the guide housing 150 are arranged magnet coils 154 which act with their magnetic force on the parts to be joined 50. If at least the lower part 50 has ferromagnetic properties, the parts to be joined 50 and the guide housing 150 can adhere to each other rigidly. With the magnetic connection shown between the parts to be joined 50 and the guide housing 150, a joint can now be made. Due to the vibration isolation the joining forces are so weak that the magnetic retaining forces also still keep the parts to be joined 50 in position when punching operations are performed without prepunching and without counter holding devices in the course of the joining process. The apparatus shown in FIG. 6 can also be used advantageously with thin unstable components or when the joint is readily accessible on one side only.

Figure 7:
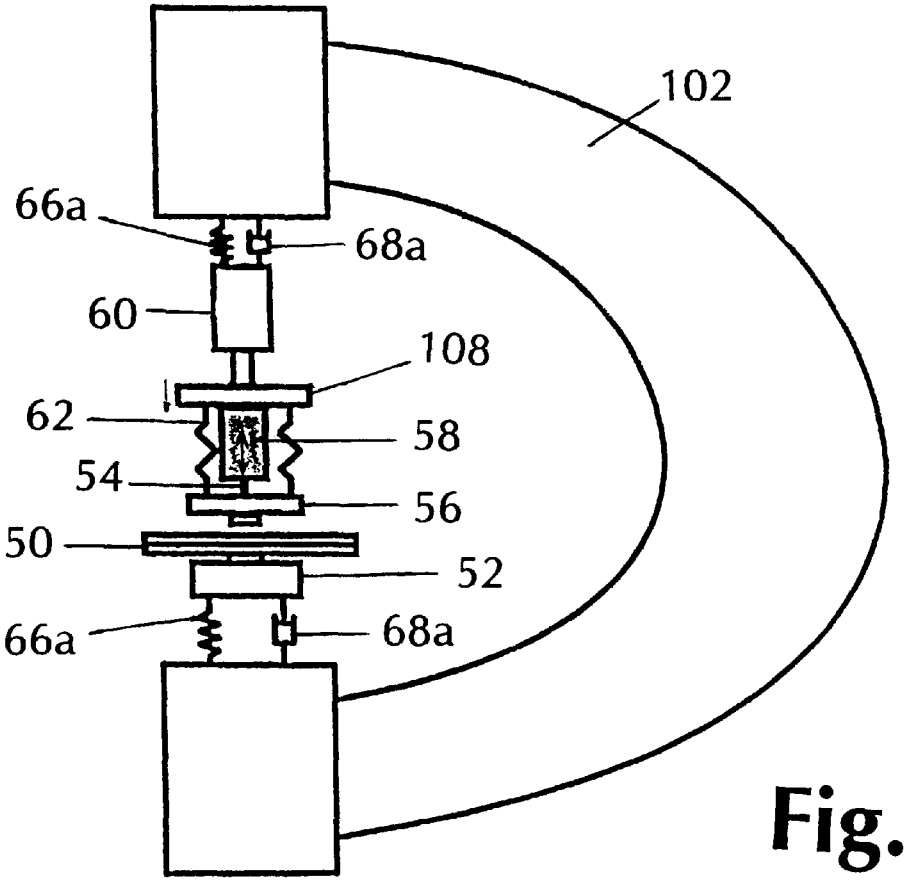
FIG. 7 illustrates a C-frame construction with variable springing and damping.

In FIG. 7 is a delivery unit 60 which is arranged in a C-frame 102. The delivery unit 60 acts on a carrier plate 108 under which is arranged a percussion mechanism 58. The impacts produced by the percussion mechanism 58 are transmitted to the ram 54. The hold-down springs 62 hold the hold-down device 56, which with the ram mounted thereon acts on the metal sheets 50. The sheets 50 rest on a die 52 which is movable and has a larger mass. Both the delivery unit 60 and the die 52 are held in the C-frame 102 by isolating springs 66*a* which in this case are variable in their spring hardness. Associated with the isolating springs 66*a* are isolating dampers 68*a* which are also made variable. The variation can be achieved for example with pneumatic or hydrostatic springs and dampers by different pressure regulation of the gas cushion. The variation in springing and damping allows both individual adaptation of the apparatus to different joining processes and parts to be joined, and a variation of the spring and damping behavior of the apparatus during a joining process.

The practical examples described here are meant only by way of illustration and on no account confined to the respective method or example. The practical examples are intended to prompt those skilled in the art to combine the proposed technical solution components advantageously or to complement them with additional components known in the art. Also it poses no problems for one skilled in the art to adapt the apparatuses and methods described for making riveted joints to other types of mechanical joints such as for example pass-through joining, blind riveting with or without prepunching, or the introduction of function carriers.

We claim:

1. An apparatus for mechanically joining metal sheets, profiles and/or multi-sheet joints lying on top of each other, comprising a frame, joining tools arranged therein and power means for moving the joining tools; the improvement comprising: at least one percussion mechanism which, to make a mechanical joint, within a short time applies several successive impacts or a pulsating force to excite one of the joining tools; means for resiliently mounting the joining tool opposite to the excited joining tool and parts to be joined; and a vibration-isolating means for keeping an exciting frequency at which the excited joining tool can be excited, higher than a characteristic frequency of the resiliently mounted opposite joining tool.

2. An apparatus according to claim 1, wherein the frame includes a substructure; and including a delivery unit and at least one percussion mechanism that is vibration-isolated from the substructure.

3. An apparatus for mechanically joining metal sheets, profiles and/or multi-sheet joints lying on top of each other, the apparatus comprising a frame, joining tools arranged on the frame, a delivery mechanism for moving the joining tools toward each other, a percussion mechanism for exciting at least one of the joining tools, and a vibration-isolating means for keeping an exciting frequency at which the at least one excited joining tool can be excited, higher than a characteristic frequency of at least one joining tool located opposite the at least one excited joining tool.

4. An apparatus according to claim 3, including variable reinforcing means for influencing the frame of the apparatus in its vibrating behavior.

5. An apparatus according to claim 3, including control means for varying the impact strength, impact number, impact speed, impact distance and/or duration of impacts of the percussion mechanisms.

6. An apparatus for mechanically joining metal sheets, profiles and/or multi-sheet joints lying on top of each other, comprising at least one guide housing, joining tools arranged therein, power means for moving at least one of the joining tools, and means for resiliently mounting at least one of the joining tools located opposite the joining tool moved by the power means and a vibration-isolating means for keeping an exciting frequency at which the at least one movable joining tool can be excited, higher than a characteristic frequency of the at least one resiliently mounted opposite joining tool.

7. An apparatus according to claim 6, including a movable hold-down device, and coupling means for synchronizing the movement of one joining tool with the movement of the hold-down device.

8. An apparatus according to claim 6, including sensors for determining data relevant to the joining process, and a control device for receiving the data and monitoring the joining process.

9. Apparatus according to claim 8, including an actuator, and wherein the control device determines by the actuator and sensors the characteristic frequency of the opposite joining tool, and varies the frequency at which the movable joining tool is excited as a function of the measured characteristic frequency by driving the actuator.

10. An apparatus according to claim 8, characterized in that the control device varies the damping characteristic of the resilient mounting means.

11. An apparatus according to claim 10, characterized in that the resilient mounting means for the at least one joining tool has additional damping.

12. An apparatus according to claim 8, characterized in that the control device derives at least one exciting frequency for at least one of the movable joining tools and a damping characteristic of the resilient mounting means from stored data.

13. An apparatus according to claim 6, characterized in that the joining tools work in operation in opposite directions.

14. An apparatus according to claim 6, characterized in that at least one of the joining tools can be adjusted to the maximum in its movement by a driven apparatus.

15. An apparatus according to claim 6, characterized in that the apparatus is integrated in a hand tool.

16. An apparatus according to claim 6, including control means for moving at least one of the joining tools synchronously with the movement of a hold-down device.

* * * * *

UNITED STATES PATENT AND TRADEMARK OFFICE

CERTIFICATE OF CORRECTION

PATENT NO. : 6,199,271 B1
DATED : March 13, 2001
INVENTOR(S) : Ortwin Hahn and Volker Schulte It is certified that error appears in the above-identified patent and that said Letters Patent is hereby corrected as shown below:

Title page,
Item (73), Please cancel the Assignee "Volker Schulte, Olsberg (DE)" and insert
-- Ortwin Hahn, Paderborn (DE) --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*